United States Patent [19]

Lautenschlager

[11] 4,065,829

[45] Jan. 3, 1978

[54] OVER-CENTER HINGE

[75] Inventor: Karl Lautenschlager, Reinheim, Odenwald, Germany

[73] Assignee: Karl Lautenschlager KG., Mobelbeschlagfabrik, Reinheim, Odenwald, Germany

[21] Appl. No.: 722,433

[22] Filed: Sept. 13, 1976

[30] Foreign Application Priority Data

Sept. 16, 1975 Germany ..... 2541144
Feb. 14, 1976 Germany ..... 2606001

[51] Int. Cl.[2] ..... E05D 11/06; E05D 3/06
[52] U.S. Cl. ..... 16/145; 16/163
[58] Field of Search ..... 16/145, 146, 142, 180, 16/182, 183, 163, 164

[56] References Cited

U.S. PATENT DOCUMENTS

| | | | |
|---|---|---|---|
| 1,919,262 | 7/1933 | Shields | 16/182 UX |
| 2,584,404 | 2/1952 | Webb | 16/142 X |
| 3,362,042 | 1/1968 | Salice | 16/163 |
| 3,590,420 | 7/1971 | Salice | 16/145 X |
| 3,744,086 | 7/1973 | Salice | 16/164 |
| 3,864,786 | 2/1975 | Salice | 16/163 |
| 3,952,368 | 4/1976 | Zernig et al. | 16/145 X |

FOREIGN PATENT DOCUMENTS

| | | | |
|---|---|---|---|
| 521,557 | 5/1940 | United Kingdom | 16/182 |

*Primary Examiner*—James Kee Chi

[57] ABSTRACT

An over-center hinge for use in furniture comprising two hinge links articulated pivotingly in the manner of a quadruple pivot on the door and wall of the furniture, a bending spring curved into a C-shape under compression bias, with re-curved end sections for biasing said hinge on one side in the closing direction and on the other side in the opening direction, the spring engaging with at least one end section a prolongation or pivot point of the hinge link associated with the end section, latter hinge link forming with the mounting arm pivot axis of this link a lever arm which is directed from the pivot axis such that, in the hinge-closed position, it is biased by the spring in the sense of a pivoting in the closing direction, and in the open position it is biased in the opening direction.

13 Claims, 8 Drawing Figures

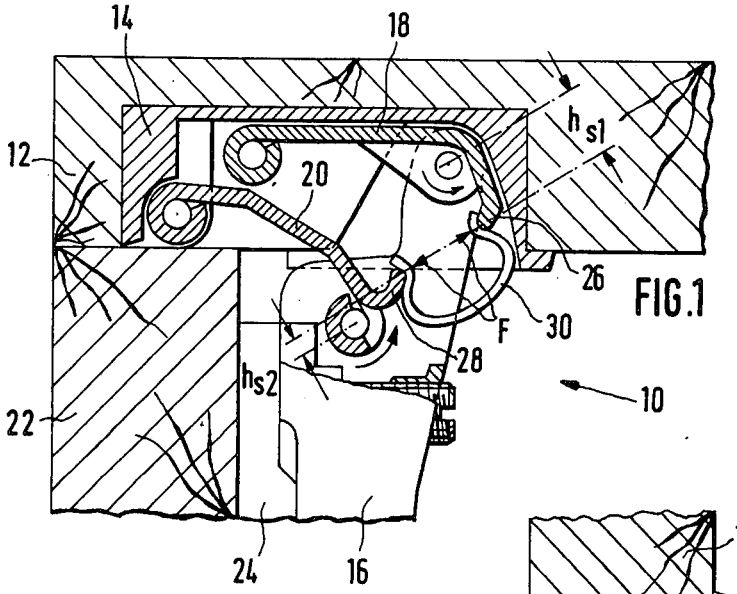
FIG.1
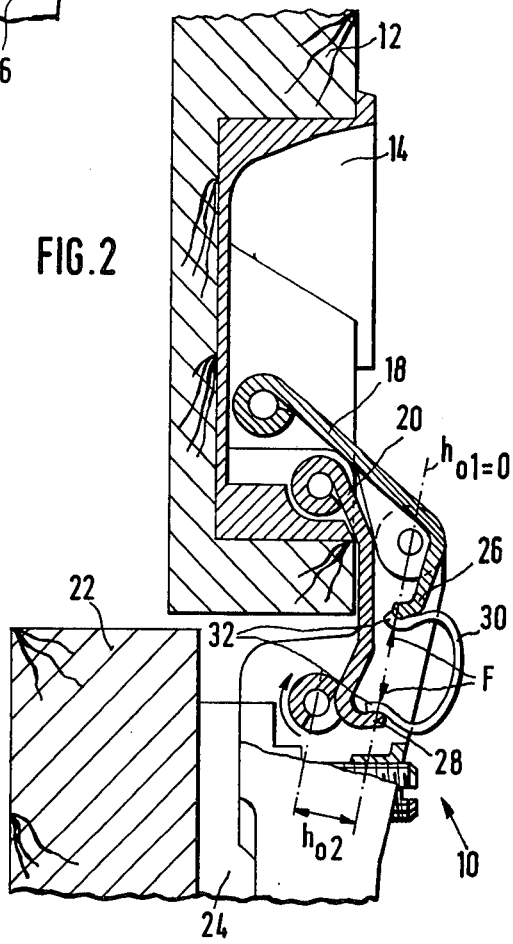
FIG.2
FIG.3
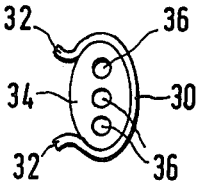
FIG.4
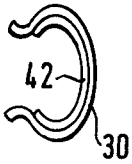

OVER-CENTER HINGE

BACKGROUND

The invention relates to an over-center hinge for furniture doors, having two hinge links articulated pivotingly in the manner of a quadruple pivot on a door part, on the one hand, and on a wall part constructed as an elongated mounting arm on the other hand, which upon swinging from the closed position to the open position is movable through a dead center position on one side of which it is biased in the closing direction and on the other side of which it is biased in the opening direction by the tension of the spring, the spring being provided in the space available between the hinge link pivot points on the mounting arm side and engaging, with at least one end, a prolongation of one of the hinge links which with the mounting arm pivot axis of this link forms a lever arm which is directed from the pivot axis such that, in the hinge-closed position, it is biased by the spring in the sense of a pivoting in the closing direction, and in the open position it is biased in the sense of a pivoting in the opening direction.

Such over-center hinges, which are biased by spring tension into two stable end positions, have the advantage that a door articulated to a piece of furniture by means of such a hinge will not remain open in intermediate positions, i.e., with the door half-way open, so as to be damaged by drawers disposed within the cabinet, such as for example drawers for pots or supplies, or kitchen appliances arranged so as to be pulled out from recesses in kitchen cabinets. Such an over-center hinge is known (German Offenlegungsschrift 21, 17 828), in which a V-shaped spring of springy strip or wire material is used for the production of the spring bias, the spring being so disposed that the apex of the V-shaped spring is wrapped around the pivot pin on the mounting arm end of one of the hinge links, while the free end of one of the legs of the spring engages a projection in the mounting-arm-end area of the other hinge link, while the second leg of the spring bears directly or indirectly on the mounting arm. The production of a sufficiently great spring force is difficult with such V-shaped springs on account of the small amount of space available, and the installation of the springs is expensive, especially when they are hairpin-like springs formed of steel spring wire spirally wound in several turns at the apex. In practice, over-center hinges of this kind have for this reason failed to become popular.

THE INVENTION

The invention, however, is addressed to the problem of creating an over-center hinge of the kind in question, which will reliably swing even heavy doors reliably into their end positions with the necessary spring bias, and in which, especially, the required spring will be simple and easy to install and even to remove again.

Setting out from a hinge of the kind described above, this problem is solved in accordance with the invention in that the spring is a bending spring of springy metal, preferably strip material made of spring steel, which is curved to a C-shape under compressive bias, and having short, recurved end sections whereby the spring engages the prolongation associated with each end section or engages a mounting part of the hinge link. The spring curved to a C-shape can be manufactured with a minimum of material and is easy to install by resiliently compressing its end sections and inserting it in the otherwise already assembled hinge between the end portions of the hinge links at their mounting-arm extremities.

If the resilient force of the spring of the hinge is to be augmented, for example for use on larger and therefore heavier closet doors, this can be accomplished by a further development of the invention by providing in the hollow of the spring-steel spring an additional resilient body of rubber-elastically deformable material, this resilient body being made preferably from polyurethane plastic. Alternatively, at least one additional, matchingly curved bending spring of springy metal can be inserted under bias into the curved hollow of the bending spring.

In a preferred embodiment of the invention, one end of the spring engages a prolongation of the inner hinge link adjacent the bearing wall, while the other end of the spring engages the pivot pin or the journal bore associated therewith on the outer hinge link which is not provided with the prolongation.

Alternatively, the design can also be such that the one end of the spring engages a prolongation of the outer hinge link farther away from the bearing wall, and the other end of the spring engages the pivot pin or the journal bore containing same on the inner hinge link which is not provided with the prolongation.

The prolongation which is engaged by the one end of the C-shaped spring is formed, in the case of the two previously mentioned embodiments, preferably by lugs bent laterally from the hinge links and a pin fixed in aligned bores in these lugs and disposed parallel to the axis of the pivot pin joining the particular hinge link to the mounting arm, over which pin the corresponding recurved end section of the C-shaped spring is hooked.

In the case in which the prolongation is provided on the outer hinge link farthest away from the bearing wall, the bent-back lugs can be carried all the way into the area of the adjacent pivot point of the hinge link, and the pivot pin which pivotingly joins the hinge link in this area to the mounting arm then passes through journal bores in the lugs. Then it is not necessary to create a journal hole by rolling the end of the hinge link.

An additional embodiment of the invention, in which the two embodiments described above are virtually combined, is characterized by the fact that the two hinge links are provided with prolongations at the mounting-arm end, between which the spring is inserted under bias, and that the prolongations are directed from the pivot axis of the articulations at the mounting arm end of the particular link such that at least one but preferably both of the lever arms formed between the points where the spring engages the prolongations and the axis of the corresponding articulation point is acted upon by the spring in the closing direction when the hinge is in the closed position, and in the opening direction when it is in the open position.

In advantageous further development of the invention, the projections, in the case of the embodiment last mentioned, can be made in one piece with the hinge links.

The invention will now be further explained with the aid of several embodiments thereof, in conjunction with the drawing, wherein:

FIG. 1 is a partial, cross-sectional top plan view taken through a cabinet door hinged in accordance with the invention to a cabinet sidewall, with the door in the closed position;

FIG. 2 is a view similar to FIG. 1 with the cabinet door in the open position;

FIG. 3 illustrates an improved design of the spring for the over-center hinge of the invention;

FIG. 4 represents still another design of the spring for the hinge of the invention;

Figure 5:
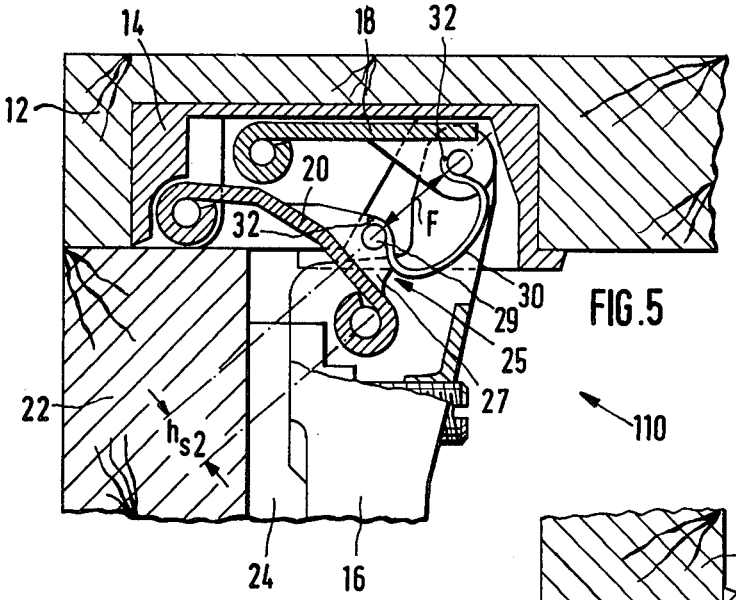
Figure 6:
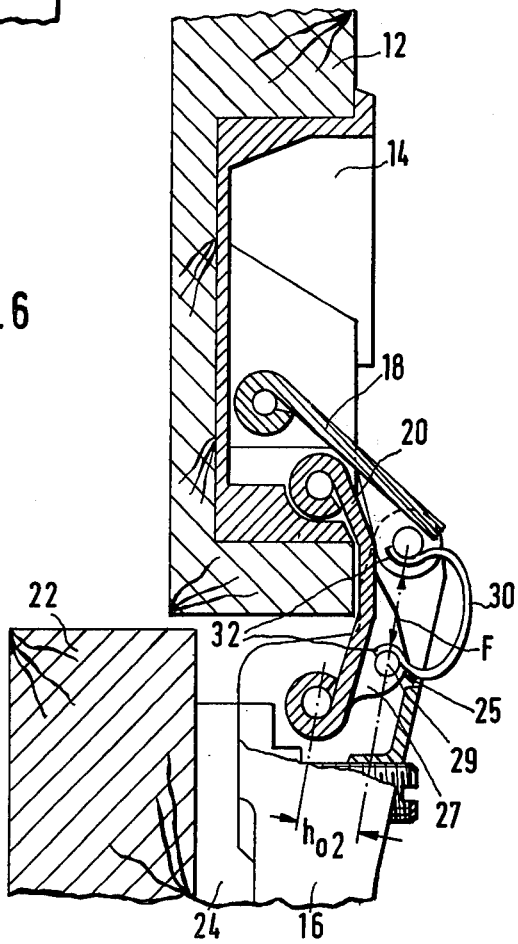

FIGS. 5 and 6 is a representation of the same kind as FIGS. 1 and 2, respectively, of a second embodiment of the hinge of the invention, and FIGS. 7 and 8 are again views of the same kind as FIGS. 5 and 6, respectively, of a third embodiment of the hinge of the invention.

The first embodiment of the hinge of the invention, which is illustrated in FIGS. 1 and 2, and is generally designated as 10, is a four-pivot hinge in which the door part, constructed in the form of a drive-fitted or recessed cup-like element 14, which is inserted into a mating recess in the cabinet door 12, is pivotally joined by two hinge links 18 and 20 to the wall part constructed in the form of an elongated mounting arm 16. The mounting of the mounting arm 16 on the sidewall 22 of the cabinet is accomplished, in a known manner, by means of a mounting plate 24 fastened to the sidewall 22. Up to this point the hinge 10 is the same as a conventional four-pivot hinge.

The over-center mechanism of hinge 10 is formed by prolongations 26 and 28 at the extremities of the hinge links 18 and 20, resectively, which are articulated to the mounting arm 16, and between which a spring 30 formed of resilient metal strip material is inserted under bias. The end sections 32 of the spring 30, which, as seen from the side, is bent to a C-shape or oval shape, engage the facing ends of the prolongations 26 and 28 in the manner apparent in FIGS. 1 and 2. The spring 30, inserted under bias, thus needs only to be slightly compressed and snapped in behind the prolongations 26 and 28 for installation. By removing the spring, the hinge is furthermore convertible to a hinge action without an over-center action.

The operation of the over-center mechanism will be explained with the aid of the lever arms, indicated in FIGS. 1 and 2, of the prolongations 26 and 28, and of the spring force of spring 30, which is indicated by the arrows F. In the closed position (FIG. 1), the effective lever arm of prolongation 26, i.e., the distance between the direction of application of the spring force F and the axis of rotation of the pivot hole of the corresponding link 18, is equal to $h_{s1}$, and the effective lever arm of prolongation 28 is equal to $h_{s2}$. The spring force F is applied to each prolongation such that a torque in the closing direction is exercised both on link 18 and on link 20.

In the open position (FIG. 2), the effected lever arm $h_{o1}$ of the prolongation 26 is just about zero, since the direction of the action of the spring force F in this case passes through the axis of rotation of the outer pivot hole of the corresponding link 18. This, however, is not essential to the operation of the hinge. Instead, it is easily apparent that even a slight extension of the prolongation 26 would result in the development of an effective lever arm $h_{o1}$ which, in conjunction with the spring force F, would result in a torque in the opening direction. The effective lever arm $h_{o2}$ of the prolongation 28, however, suffices to produce a torque sufficiently great to carry the door 12, after it passes through the dead center position, into the open position, and to hold it open. In the embodiment under discussion, the production of a torque acting on the link 18 with the hinge in the open position has been purposely avoided, in order to reduce the force holding the door in the open position to less than the force holding it in the closed position. What is essential to the operation of the hinge is only that the sum of the two torques exercised on the hinge links suffices to convey the door to the desired position and hold it there with the necessary force.

In addition to the length of the effective lever arms $h_{s1}, h_{s2}$, $h_{o1}$ and $h_{o2}$, the force by which the door is urged to the particular end position depends, of course, also on the spring force F which in the above explanation has been assumed to be constant, although it actually varies according to the variation of the distance between the ends of the prolongations 26 and 28 on the basis of the greater or lesser compression of the spring 30. Since, however, the variations in this distance are slight, the variation in the spring force is also negligible. By varying the strength of the spring 30, the strength of the over-center action can be adapted to a variety of requirements.

A method of increasing the force of spring 30 is represented in FIG. 3. A resilient body 34 made of rubber-elastic material is inserted into the opening defined by the oval curvature of spring 30. One material that can be used for making the resilient body is polyurethane plastic whose resilient properties can be varied within a broad range during manufacture. Furthermore, a variation of the springing action of resilient body 34 can be achieved by varying the number and size of the cross-holes 36 diagrammatically indicated in FIG. 3.

The force of spring 30 can also be augmented in the manner represented in FIG. 4. Instead of the additional resilient body 34 described in conjunction with FIG. 3, one (or even more in case of necessity) spring 42 of matching curvature can be inserted into spring 30 under bias. By this bias not only is the force of spring 30 increased, but also the additional spring 42 is held by its own force within spring 30 without the use of other fastening means. Consequently, spring 42 can be removed again, if necessary, without difficulty.

In FIGS. 5 and 6 there is shown another embodiment of a hinge in accordance with the invention, which is generally designated by reference number 110, and which is largely the same as the hinge described in conjunction with FIGS. 1 and 2, the parts they have in common being assigned the same reference numbers. The general description of the embodiment contained in FIGS. 5 and 6 can thereby be abbreviated to avoid repetition.

In contrast to the embodiment previously described in conjunction with FIGS. 1 and 2, the over-center mechanism of hinge 110 is formed by only one prolongation 25 composed of two lugs 27 bent outwardly at right angles from the inner hinge link 20 towards the other hinge link 18, plus a pin 29 fixed in aligned bores in lugs 27 and disposed parallel to the axis of the pivot connecting the link 20 to the mounting arm 16. This pin 29 supports the recurved end section 32 of the spring 30 bent to oval shape, whose other recurved end section 32 is urged under bias against the pivot connecting the other hinge link 18 to the mounting arm. For assembly, here again the spring 30 needs only to be slightly compressed and engaged with the pin 29 at one end and the mounting arm pivot of link 18 at the other. In this embodiment, too, the removal of the spring converts the hinge at any time to plain hinge action without the over-center action. The operation of the over-center mechanism is based on the fact that the prolongation 25 has an effective lever arm on the mounting arm pivot of link 20, which is acted on by the force F of the spring 30, whereby the spring exercises a torque on the hinge link. In the closed position (FIG. 5), the lever arm identified as $h_{s2}$ has such a position that the hinge link 20 is urged by the spring force F in the closing direction, while the effective lever arm $h_{o2}$ of the prolongation 25 in the open position is urged by the spring force F in the direction of an opening movement of the hinge link 20. The door 12 of the cabinet equipped with the hinge 110 is thus resiliently biased to the closed position when it is closed, and when it is open it is resiliently biased to the open position, so that the door, when it is any position except the dead center position, in which the effective lever arm $h$ becomes just about zero, will have the tendency to assume one or the other of the two stable end positions.

Figure 7:
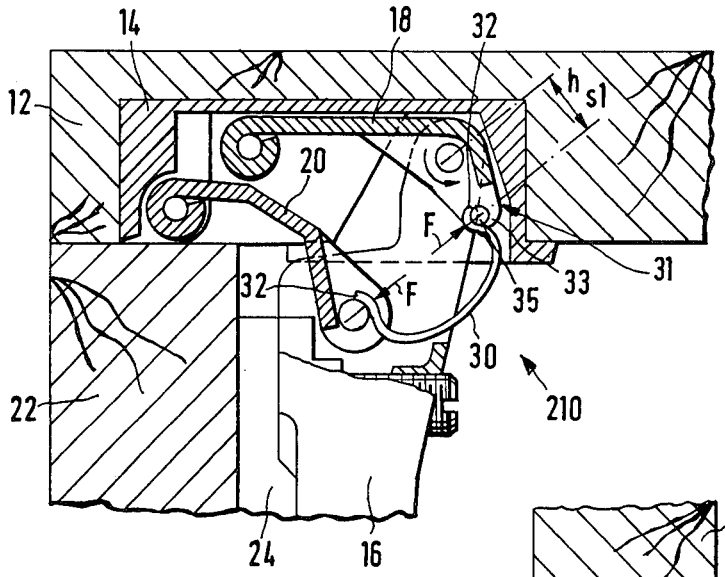
Figure 8:
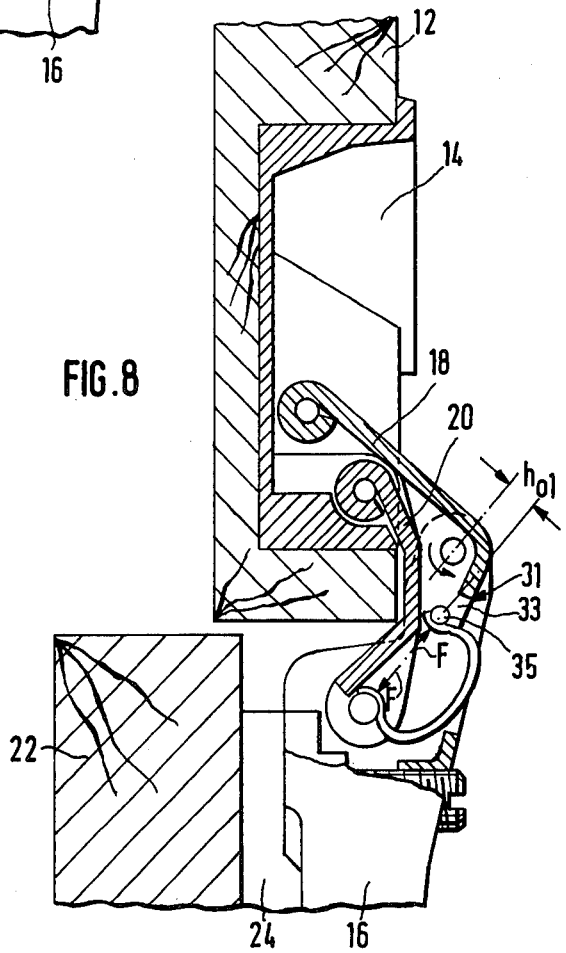

The hinge 210 illustrated in FIGS. 7 and 8 differs from the hinge latterly described only in that the prolongation, which is here designated as 31, is provided on the outer hinge link 18. Here again, the prolongation consists of two lateral lugs 33 and a pin 35 extending between the lugs 33 parallel to the axis of the corresponding pivot. The design is again such that the effective lever arms $h_{s1}$ and $h_{o1}$ are acted upon in the closed position and in the open position by the spring force F to the effect of exercising a closing and opening torque, respectively, upon the hinge link 18. In operation the hinge 210 is thus the same as that of hinges 10 and 110 described previously.

The lugs 33 of the hinge link 18 also serve in the case of hinge 210 for the mounting of the mounting arm pivot pin.

The over-center hinges of the invention, which have been described above operate securely and reliably while being very simple in construction, and they can be made at only slightly higher cost than conventional four-pivot hinges.

I claim:

1. An over-center hinge for use in furniture having a door part and a wall part, having a mounting arm comprising: two hinge links articulated pivotingly in the manner of a quadruple pivot on the door part and on the wall part, each hinge link having a pivot point with a pivot pin or a journal hole, said hinge upon swinging from the closed position to the open position being movable through a dead center position, a spring for biasing said hinge on one side in the closing direction and on the other side in the opening direction, said spring being provided in the space between the hinge link pivot points on the mounting arm side, said spring being a bending spring of springy material, curved into a C-shape and having short, re-curved end sections, said spring being permanently biased by elastically bending said recurved end sections together and being snapped in this biased state between the hinge links on the mounting arm side and engaging with at least one of said end sections a prolongation of one of said links, said prolongation forming with the mounting arm pivot axis of this link a lever arm which is directed from the pivot axis such that, in the hinge-closed position, it is biased by the spring in the sense of a pivoting in the closing direction, and in the open position it is biased in the sense of a pivoting in the opening direction.

2. An over-center hinge according to claim 1, wherein a resilient body of rubber-elastically deformable material is disposed in the hollow of the C-shaped bending spring.

3. An over-center hinge according to claim 2, wherein the rubber-elastic resilient body is made of polyurethane plastic.

4. An over-center hinge according to claim 1, comprising at least one additional, matchingly curved bending spring of springy metal inserted under bias into the curved interior of the C-shaped bending spring.

5. An over-center hinge according to claim 1, wherein said spring engages with its one end section a prolongation of the inner hinge link closer to the bearing wall, and wherein the second end section of the spring engages the pivot pin or the journal associated therewith on the hinge link which is not provided with the prolongation.

6. An over-center hinge according to claim 1, wherein said spring engages with its one end section a prolongation of the outer hinge link farther from the bearing wall, and wherein the second end section of the spring engages the pivot pin or the journal hole associated therewith on the hinge link not provided with the prolongation.

7. An over-center hinge according to claim 5, wherein said prolongation is formed by lugs bent laterally away from the hinge link and a pin fixed in aligned bores in the lugs and disposed parallel to the axis of the pivot pin connecting the respective hinge link to the mounting arm.

8. An over-center hinge according to claim 6, wherein said prolongation is formed by lugs bent laterally away from the hinge link and a pin fixed in aligned bores in the lugs and disposed parallel to the axis of the pivot pin connecting the respective hinge link to the mounting arm.

9. An over-center hinge according to claim 7, wherein said lugs are carried all the way into the area of the adjacent pivot point of the hinge link, and that the pivot pin joining the hinge link pivotingly to the mounting arm in this pivot area passes through journal bores in the lugs.

10. An over-center hinge according to claim 8 wherein said lugs are carried all the way into the area of the adjacent pivot point of the hinge link, and that the pivot pin joining the hinge link pivotingly to the mounting arm in this pivot area passes through journal bores in the lugs.

11. An over-center hinge according to claim 1, wherein both hinge links are provided in the mounting arm linking area with prolongations between which the spring is inserted under bias, and that the prolongations are so directed from the pivot axis of the mounting arm linking point of the respective link that at least one, of the lever arms formed between the points of engagement of the springs with the prolongations and the axis of the corresponding pivot point are acted upon by said spring in the closing direction when in the hinge-closed position, and in the opening direction when in the open position.

12. An over-center hinge according to claim 11, wherein both said lever arms are acted upon by said spring in the closing direction when in the hinge-closed position, and in the opening direction when in the open position.

13. An over-center hinge according to claim 11, wherein the prolongations are made in one piece with the hinge links.

* * * * *